US006151894A

United States Patent [19]

Endo et al.

[11] Patent Number: 6,151,894

[45] Date of Patent: Nov. 28, 2000

[54] APPARATUS FOR RECOVERING PRESSURE OIL RETURNED FROM ACTUATORS

[75] Inventors: Hiroshi Endo; Nobumi Yoshida; Kazuhiro Maruta, all of Tochigi, Japan

[73] Assignee: Komatsu Ltd., Tokyo, Japan

[21] Appl. No.: 09/331,788

[22] PCT Filed: Dec. 25, 1997

[86] PCT No.: PCT/JP97/04844

§ 371 Date: Jun. 25, 1999

§ 102(e) Date: Jun. 25, 1999

[87] PCT Pub. No.: WO98/29664

PCT Pub. Date: Jul. 9, 1998

[30] Foreign Application Priority Data

Dec. 26, 1997 [JP] Japan ..... 8-347707

[51] Int. Cl.[7] ..... F16D 31/02

[52] U.S. Cl. ..... 60/414

[58] Field of Search ..... 60/414, 417

[56] References Cited

U.S. PATENT DOCUMENTS 4,928,487 5/1990 Nikolaus .

5,878,569 3/1999 Satzler ..... 60/418

FOREIGN PATENT DOCUMENTS 63-67403 3/1988 Japan .

63-212699 9/1988 Japan .

*Primary Examiner*—F. Daniel Lopez

*Attorney, Agent, or Firm*—Armstrong, Westerman, Hattori, McLeland & Naughton

[57] ABSTRACT

A system that can recover flows of a hydraulic pressure fluid returned from a plurality of hydraulic actuators is disclosed which includes a plurality of fluid recovery circuits (15, 19, 25 and 27) into which flows of a hydraulic pressure fluid returned from such a plurality of actuators are admitted, and a main fluid recovery circuit (36). There is provided a selector means (30, 31, 32, 33, 34, 35, 37) for permitting at least one of the plural fluid recovery circuits (15, 19, 25 and 27) selectively to communicate with the main fluid recovery circuit (36). The system, by permitting at least one of a plurality of fluid recovery circuits to communicate with a main fluid recovery circuit, enables a hydraulic return pressure fluid from at least one of a plurality of actuators to be recovered and hence is applicable to a working machine involving a plurality of hydraulic actuators.

6 Claims, 5 Drawing Sheets

APPARATUS FOR RECOVERING PRESSURE OIL RETURNED FROM ACTUATORS

TECHNICAL FIELD

The present invention relates to a hydraulic actuator return pressure fluid recovery system and in particular to a system for recovery of flows of a hydraulic pressure fluid returned from a plurality of hydraulic actuators, and thereby recycling the fluid to drive another actuator.

BACKGROUND ART

It has hitherto been the practice to connect a return circuit from one given hydraulic actuator to another hydraulic actuator whereby to recover and recycle a return fluid from the one actuator to drive the other actuator.

A recovery apparatus known in the art is available to recycle a hydraulic apparatus in which only one hydraulic actuator is included as operable at a time. Unfortunately, it is not applicable to a working machine such as a hydraulic power shovel in which a plurality of hydraulic actuators such as a boom cylinder, an arm cylinder and a turning hydraulic motor are included and where these actuators must be operated simultaneously.

In particular, if in the known apparatus the return circuits of such more than one hydraulic actuators are connected to one separate hydraulic actuator, these return circuits are in effect placed in fluid communication with each other. Then, an attempt to operate one of the actuators in a direction opposite to its return direction may cause all the actuators to so operate simultaneously.

It is accordingly an object of the present invention to provide an actuator return fluid recovery apparatus which is designed to resolve the problem mentioned above.

SUMMARY OF THE INVENTION

In order to achieve the object mentioned above, there is provided in accordance with the present invention in a certain form of implementation thereof a hydraulic actuator return pressure fluid recovery system that comprises a plurality of fluid recovery circuits associated with a plurality of hydraulic actuators for accepting flows of a hydraulic pressure fluid returned from the said actuators; a main fluid recovery circuit; and a selector means that permits at least one of said plural fluid recovery circuits selectively to communicate with the said main fluid recovery circuit.

The system construction described above in which at least one of a plurality of return fluid recovery circuits are rendered to selectively communicate with a main fluid recovery circuit, permits recovery of a pressure fluid from at least one of a plurality of hydraulic actuators.

Thus, the system is applicable to a working machine involving a plurality of hydraulic actuators.

In the system construction described above, it is preferred that the said selector means be designed to selectively establish a first state in which only any one of the said fluid recovery circuits is placed in fluid communication with the said main fluid recovery circuit and a second state in which more than one of the said fluid recovery circuits lie in fluid communication with the said main fluid recovery circuit.

The preferred system construction just described which enables a plurality of fluid recovery circuits to be individually placed in fluid communication with the main fluid recovery circuit permits a return fluid solely from any one of the actuators when it is singly operated to be recovered.

That preferred system construction which also enables more than one fluid recovery circuits to communicate with the main fluid recovery circuit allows flows of return fluid from more than one hydraulic actuators when they are simultaneously operated to merge into a single flow to be recovered.

In the preferred system construction noted above, it is further preferred that the said selector means when more than one of said fluid recovery circuits lie in fluid communication with said main fluid recovery circuit be designed to establish a third state in which a hydraulic return pressure fluid flow from a particular one of the said fluid recovery circuits preferentially is admitted into the said main fluid recovery circuit.

The further preferred system construction just described permits a return pressure fluid from only one of more than one hydraulic actuators to be recovered when and while they are simultaneously operated with different operating speeds.

For instance, where it is desired to operate a boom and an arm cylinder in a power shovel simultaneously with different operating speeds controlled, it will be apparent that while establishing fluid communication of both the fluid recovery circuits for the boom and arm cylinders with the main fluid recovery circuit disables the boom and arm cylinders from being controlled of their operating speeds simultaneously, then the boom and arm cylinders can be operated simultaneously with operating speeds separately controlled if a return pressure fluid only from the boom cylinder is allowed to be recovered.

In the basic, preferred or further preferred system construction, it is desirable that there be provided in a said fluid recovery circuit a back pressure compensating valve adapted to permit a hydraulic return pressure fluid flow to pass therethrough selectively upon an influent side fluid pressure thereof exceeding a predetermined level, regardless of a drain side fluid pressure thereof.

This specific system construction permits a back pressure of a predetermined level to develop in the fluid recovery circuit in which the pressure compensating valve is provided, regardless of any level of pressure prevailing in the main fluid recovery circuit.

Thus, for example, where return pressure fluid flows from the turning motor and the boom cylinder are simultaneously recovered, development of a back pressure of a predetermined level in the return pressure fluid from the turning motor permits a given pressure in the boom cylinder to be held.

In the basic, preferred and further preferred system constructions described above, it is also preferred that the said selector means include: an on/off valve provided in each of the said fluid recovery circuits and operable to be opened in response to a signal that operates a directional control valve to be switched over for supplying a said actuator corresponding thereto with a hydraulic pressure fluid; a selector valve provided in one of two of the said plural fluid recovery circuits and operable to be opened in response to a signal that operates a directional control valve to be switched over for supplying a said actuator corresponding thereto with a hydraulic pressure fluid; and a priority valve for preferentially connecting the one of the said two fluid recovery circuits to the said main fluid recovery circuit.

According to this specific system construction, switching a said directional control valve to supply a said actuator with a hydraulic pressure fluid opens the on/off valve provided in the fluid return circuit for that actuator to permit the return pressure fluid from that actuator to be admitted in the main fluid recovery circuit.

Thus, return pressure fluid from one given actuator can be recovered simply by switching one directional control valve that corresponds to it, thereby simplifying the fluid recovery operation.

Also, where two of the directional control valves are simultaneously switched to supply the two corresponding actuators with hydraulic fluid, the said priority valve allows return pressure fluid through the said one fluid return circuit to be admitted into the main fluid return circuit.

Thus, two actuators can be operated simultaneously to operate with different operating speeds controlled while permitting return pressure fluid from one of the actuators to be recovered.

In the specific system construction described above, it is preferred that a said fluid recovery circuit other than the said two fluid recovery circuit include a back pressure compensating valve adapted to permit a hydraulic return pressure fluid flow to pass therethrough selectively when an influent side fluid pressure exceeds a predetermined level, regardless of a drain side fluid pressure thereof.

According to this further specific system construction, development of a back pressure of a preset level by the said back pressure compensating valve in the relevant fluid recovery circuit regardless of any prevailing pressure in the main fluid recovery circuit may produce a braking pressure in the return fluid from the turning motor.

So constructed and arranged, it is seen that the subject return pressure fluid recovery system is well suited to the recovery of return pressure fluid flows from a boom cylinder, an arm cylinder and a turning motor in a hydraulic power shovel.

Then, while the boom and the arm cylinders are simultaneously operating, the priority valve may permit recovery of return pressure fluid from the boom cylinder. While boom and arm cylinders and the turning hydraulic motor are each solely operating, provision of a back pressure compensating valve in the fluid recovery circuit for the turning hydraulic motor to create a braking pressure allows the return pressure fluid from each of these actuators to be individually recovered. Likewise, while the boom and arm cylinders are operating simultaneously, the back pressure compensating valve permits the return pressure fluid from the boom cylinder to be recovered. And, the boom or arm cylinder and the turning hydraulic motor are simultaneously operating, the same permits the return pressure fluid flows from both the boom or arm cylinder and the turning hydraulic motor to be recovered. Yet, creating a braking pressure then in the return pressure fluid from the turning hydraulic motor allows the turning hydraulic motor to cease rotating in a shortened period of time.

In these system constructions described, it is also preferred that an on/off valve in a said fluid recovery circuit in which a pressure occurs due to an external load in a said actuator is opened.

According to this specific system construction, a return pressure fluid from a said actuator for that fluid recovery circuit in which a pressure develops due to an external load in that actuator is recovered, thus the pressure created by an external load for a particular one of the actuators is recovered; hence a reduced energy loss results. For example, a holding pressure created by an external load in an actuator cylinder, or a holding pressure created by an inertia rotation force of an external load in the hydraulic motor is recovered with a reduced loss of energy that ensues.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings hereof are intended in no way to limit the present invention but to facilitate an explanation and understanding thereof.

In the accompanying drawings.

BEST MODES FOR CARRYING OUT THE INVENTION

Hereinafter, suitable embodiments of the present invention with respect to an actuator return pressure fluid recovery system are set out with reference to the accompanying drawings hereof.

An explanation is now given of a first form of embodiment of the present invention.

Figure 1:
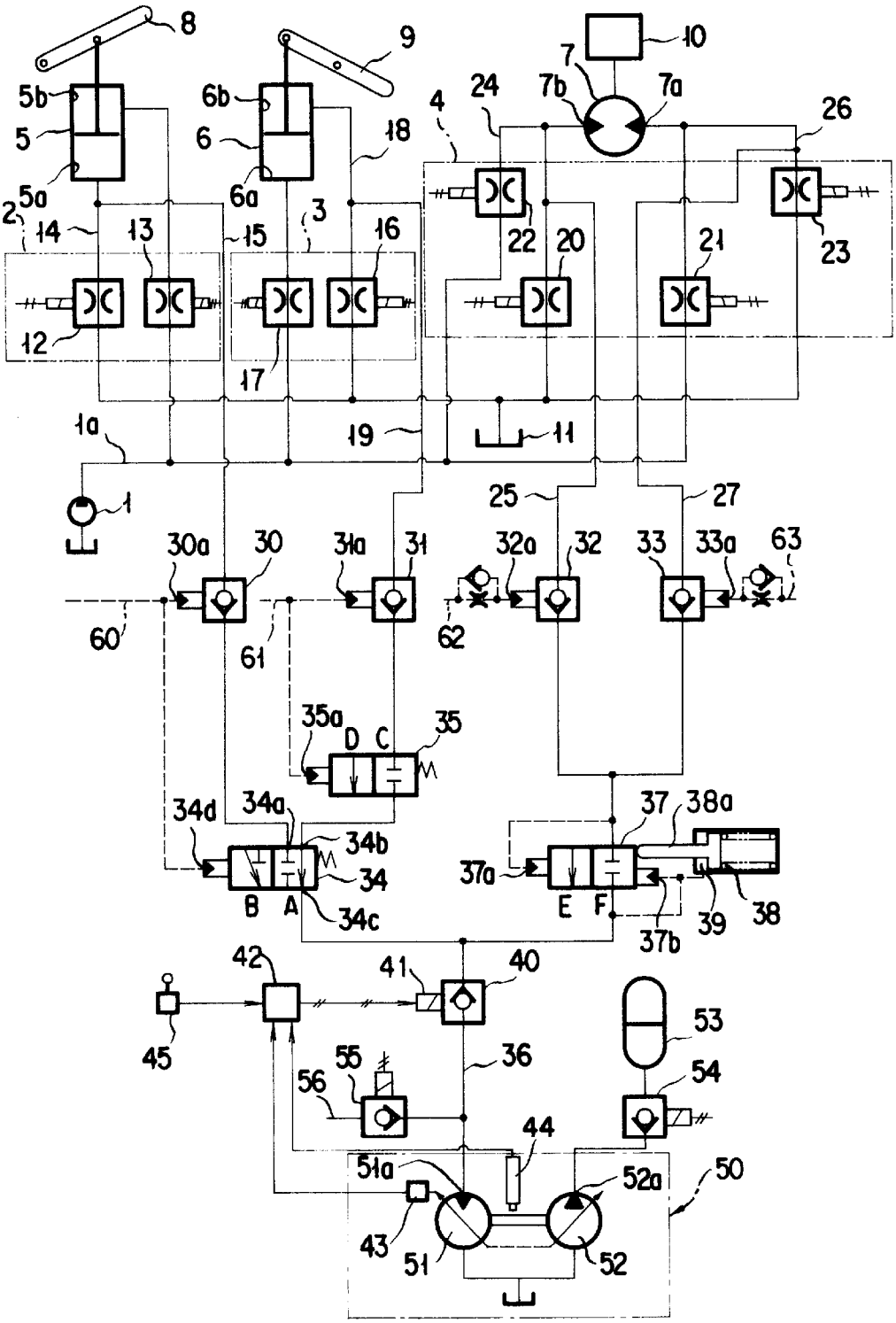
FIG. 1 is a diagrammatic construction explanatory view that shows a first form of embodiment of a system for recovery a pressure fluid returned from a plurality of hydraulic actuators in accordance with the present invention.

Referring to FIG. 1, a hydraulic pump 1 issues a discharge pressure fluid that is supplied via a first, a second and a third directional control valve 2, 3 and 4 into a first, a second and a third actuator 5, 6 and 7, respectively, as shown. Here, the first actuator 5 represents a boom cylinder for vertically swinging a boom 8 in a power shovel. The second actuator 6 represents an arm cylinder for vertically swinging an arm 9 in the power shovel. The third actuator 7 represents a turning motor for driving a swivel 10 that is mounted riding on the power shovel.

The first actuator 5 is constructed and arranged so that when its first fluid chamber 5*a* (extension chamber) is supplied with pressure fluid, it may be extendingly operated to swing the boom 8 upwards and when its second fluid chamber 5*b* (contracting chamber) is supplied with pressure fluid, it may be contractingly operated to swing the boom 8 downwards. And, the first chamber 5*a* may have a holding pressure created by the weight of the boom 8.

The first directional control valve 2 has a first meter-out valve 12 for establishing and blocking a fluid communication of the first fluid chamber 5*a* with a fluid reservoir 11 and a first meter-in valve 13 for establishing and blocking a fluid communication of the second fluid chamber 5*b* with the discharge outlet 1*a* of the hydraulic pump 1. Though not shown, it should be noted that the first directional control valve 2 also includes a second meter-in valve for establishing and blocking a fluid communication of the first fluid chamber 5*a* with the discharge outlet 1*a* of the hydraulic pump 1 and a second meter-out valve for establishing and blocking a fluid communication of the second fluid chamber 5*b* with the fluid reservoir 11.

The first meter-out valve 12 is connected to the first fluid chamber 5*a* via a fluid circuit 14 to which is connected a first fluid recovery circuit 15. And, the first fluid chamber 5*a* may issue a return fluid that is allowed to flow into the first fluid recovery circuit 15 when the first actuator 5 is contractingly operated.

The second actuator 6 is constructed and arranged so that when its first fluid chamber 6*a* (extension chamber) is supplied with pressure fluid, it may be extendingly operated to swing the arm 9 downwards and when its second fluid chamber 6*b* (contraction chamber) is supplied with pressure fluid, it may be contractingly operated to swing the arm 9 upwards. And, the second fluid chamber 6*b* may have a holding pressure created by the weight of the arm 9.

The second directional control valve 3 has a first meter-out valve 16 for establishing and blocking a fluid communication of the second fluid chamber 6*b* with the fluid reservoir 11, and a first meter-in valve 17 for establishing and blocking a fluid communication of the first fluid chamber 6*a* with the discharge outlet 1*a* of the hydraulic pump 1. Though not shown, it should be noted that the second directional control valve 3 also has a second meter-in valve for establishing and blocking a fluid communication of the the second fluid chamber 6*b* with the discharge outlet 1*a* and a second meter-out valve for establishing and blocking a fluid communication of the first fluid chamber 6*a* with the fluid reservoir 11.

The first meter-out valve 16 is connected to the second fluid chamber 6*b* via a fluid circuit 18 to which is connected a second fluid recovery circuit 19. And, the second fluid chamber 6*b* may issue a return fluid that is allowed to flow into the second fluid recovery circuit 19 when the second actuator 6 is extendingly operated.

The third actuator 7 is constructed and arranged so that when its first fluid port 7*a* is supplied with pressure fluid it may be rotated counter-clockwise as shown to turn the upper swivel 10 counter-clockwise and when its second fluid port 7*b* is supplied with pressure fluid it may be rotated clockwise as shown to turn the upper swivel 10 counter-clockwise. And, the first and second fluid ports 7*a* and 7*b* each have a holding pressure created by the force of inertia.

The third directional control valve 4 includes a first meter-out valve 20 for establishing and blocking a fluid communication of the second fluid port 7*b* with the fluid reservoir 11, a first meter-in valve 21 for establishing and blocking a fluid communication of the first fluid port 7*a* with the discharge outlet 1*a* of the hydraulic pump 1, a second meter-in valve 22 for establishing and blocking a fluid communication of the second fluid port 7*b* with the discharge outlet 1*a* of the hydraulic pump 1, and a second meter-out valve 23 for establishing and blocking a fluid communication of the first fluid port 7*a* with the fluid reservoir 11.

The first meter-out valve 20 is connected to the second fluid port 7*b* via a fluid circuit 24 to which is connected a third fluid recovery circuit 25. And, the second fluid port 7*b* may issue a return fluid that is allowed to flow into the third fluid recovery circuit 25 when the third actuator 7 is operated to turn the upper swivel 10 counter-clockwise.

The second meter-out valve 23 is connected to the first fluid port 7*a* via fluid circuit 26 to which is connected a fourth fluid recovery circuit 27. And, the first fluid port 7*a* may issue a return fluid that is allowed to flow into the fourth fluid recovery circuit 27 when the third actuator 7 is operated to turn the upper swivel 10 clockwise.

The first, second, third and fourth fluid recovery circuits 15, 19, 25 and 27 are provided with a first, a second, a third and a fourth on/off valve 30, 31, 32 and 33, respectively. The on/off valves 30, 31, 32 and 33 are pilot operated check vales, each being adapted to be rendered on or opened when a pilot pressure is applied to a respective pressure receiving portion 30*a*, 31*a*, 32*a*, 33*a*.

The first fluid recovery circuit 15 is connected to a first fluid inlet port 34*a* of a priority valve 34, and the second fluid recovery circuit 19 is connected to a second fluid inlet port 34*b* of the priority valve 34 via a selector valve 35. The priority valve 34 is normally held to assume its first position A under a spring force to place the second fluid inlet port 34*b* and a fluid outlet port 34*c* in a fluid communication with each other. And, the priority valve 34 has a pressure receiving portion 34*d* such that when a pressure fluid is applied to it the priority valve 34 may be switched to assume its second position B to render the first fluid inlet port 34*a* and the fluid outlet port 34*c* to communicate with each other. The fluid outlet port 34*c* is connected to a main fluid recovery circuit 36.

The selector valve 35 is normally held under a spring force to assume its close position C and may be switched to assume its open position D when its pressure receiving portion 35*a* has a pressure fluid applied thereto.

The third and fourth fluid recovery circuits 25 and 27 running together are connected to the main fluid recovery circuit 36 via a back pressure compensating valve 37. The back pressure compensating valve 37 is arranged to be forced to assume its fluid communication position E under an upstream fluid pressure applied to its first pressure receiving portion 37*a* and to be forced to assume its fluid blocking position F under a downstream fluid pressure applied to its second pressure receiving portion 37*b* plus a spring force applied by a spring 38 to the back pressure compensating valve 37 via a piston rod 38*a*. Here, the downstream fluid pressure is also used to act inside the pressure receiving chamber 39 that is designed to produce a force acting on the piston rod 38*a* to push it in a direction in which the spring force by the spring 38 is reduced. Thus, notwithstanding a change in the downstream fluid pressure the thrust closing the back pressure compensating valve 37 is due to the spring force by the spring 38 which is at a predetermined level, provided that the downstream fluid pressure does not exceed the level.

With the back pressure compensating valve 37 so arranged, thus permitted to be closed by assuming the position F as long as the pressure of the third and fourth fluid recovery circuits 25 and 27 (their upstream fluid pressure) falls below a preset level and to be opened by assuming the position E as long as it remains exceeding that level, the pressure of the third and fourth fluid recovery circuits 25 and 27 can be compensated for to remain above that preset level.

It follows therefore that while the third actuator 7 is being rotated to stop in order to turn the upper swivel to stop it, a set pressure can develop in the third, fourth fluid recovery circuit 25, 27 to act to brake the rotation.

The main fluid recovery circuit 36 includes a fluid recovery check valve 40 which has its opening varied in proportion to the magnitude of an electric current applied to a solenoid 41 under control by a controller 42.

The main fluid recovery circuit 36 is connected to a pressure converter 50 in which a first and a second variable displacement pump/motor unit 51 and 52 are mechanically coupled together to be rotatable at an identical speed of rotation. The first variable displacement pump/motor unit 51 has a fluid port 51*a* connected to the main fluid recovery circuit 36, and the second variable displacement pump/motor unit 52 has a fluid port 52*a* connected to a fluid accumulator 53.

The arrangement being as such, the first variable displacement pump/motor unit 51 may be driven by a pressure fluid from the main fluid recovery circuit 36 to operate as a motor while causing the second variable displacement pump/motor unit 52 to operate as a pump, the pressure fluid being admitted through the check valve 54 into the accumulator 53 with its pressure stored therein.

And, with the check valve 54 being opened, the pressure fluid in the accumulator 53 with its pressure stored therein may drive the second variable displacement pump/motor unit 52 to operate as a motor, causing the first variable displacement pump/motor unit 51 to operate as a pump, the pump discharging fluid of an elevated pressure into the main fluid recovery circuit 36. The fluid of an elevated pressure discharged into the main fluid recovery circuit 36 may be supplied through a fluid circuit 56 with a check valve 55 to the discharge outlet 1*a* of the hydraulic pump 1 and may thus be recycled.

The displacement or capacity of the first variable displacement pump/motor unit 51, e.g., in terms of a swash plate angle thereof, may be sensed by a displacement or capacity sensor 43 and a signal indicative of it supplied to the controller 42. The speed of rotation of the first variable displacement pump/motor unit 51 may be sensed by a rotation sensor 44 and a signal indicative of it furnished to the controller 42.

The controller 42 computes the rate of flow of the fluid passing through the main fluid recovery circuit 36 (the rate of a return fluid flow from an actuator), based on a displacement and a speed of rotation signal received. The speed of motion of the actuator is computed from the rate of flow thus computed. A speed of motion signal that thus is compared with a reference signal that represents a preset speed of motion of the actuator to provide a differential output which is used to control the electric current applied to the solenoid 41, thereby controlling the opening of the fluid recovery check valve 40.

The controller 42 is furnished with a preset speed signal from a speed setting means 45.

Thus, the speed of movement of the first actuator 1, second actuator 6 in the direction in which it may fall by its own weight may be controlled as desired.

An explanation is next given of a return fluid recovery operation of the system.

Fluid Recovery from the First Actuator 5

In the first directional control valve 2, the first meter-out valve 12 is closed and the first meter-in valve 13 is opened. A pilot fluid pressure is applied to the first pilot circuit 60 to open the on/off valve 30 and to set the priority valve 34 at its second position B.

This will cause the first actuator 5 to be contractingly operated, permitting the pressure fluid in the first fluid chamber 5*a* to flow out, flowing as a return fluid through the first fluid recovery circuit 15 into the main fluid recovery circuit 36 for recovery therein.

Fluid Recovery from the Second Actuator 6

In the second directional control valve 3, the first meter-out valve 16 is closed and the second meter-in valve 17 is opened. A pilot fluid pressure is applied to the second pilot circuit 61 to open the second on/off valve 31 and to set the selector circuit 35 at its open position D.

This will cause the second actuator 6 to be extendingly operated, permitting the pressure fluid in the second fluid chamber 6*b* to flow out, flowing as a return fluid through the second fluid recovery circuit 19 into the main fluid recovery circuit 36 for recovery therein.

Fluid Recovery from the Third Actuator 7 Rotating Counterclockwise

In the third directional control valve 4, the first meter-out valve 20 is closed and the first meter-in valve 21 is opened. A pilot fluid pressure is applied to the third pilot circuit 62 to open the third on/off valve 32.

This will cause fluid to flow out of the third actuator 7 through the second fluid port 7*b,* flowing as a return fluid through the third fluid recovery circuit 25 into the main fluid recovery circuit 36 for recovery thereby.

Fluid Recovery from the Third Actuator 7 Rotating Clockwise

In the third directional control valve 4, the second meter-out valve 23 is closed and the second meter-in valve 22 is opened. A pilot fluid pressure is applied to the fourth pilot circuit 63 to open the fourth on/off valve 33.

This will cause fluid to flow out of the third actuator 7 through the first fluid port 7*a,* flowing as a return fluid through the fourth fluid recovery circuit 27 into the main fluid recovery circuit 36 for recovery thereby.

Fluid Recovery from Both the First and Third Actuators 5 and 7

In the manner like the above, a return fluid is allowed to flow through the first fluid recovery circuit 15 and the third or fourth fluid recovery circuit 25 or 27 into the main fluid recovery circuit 36 for recovery therein.

Fluid Recovery from Both the Second and Third Actuators 6 and 7

In the manner like the above, a return fluid is allowed to flow through the second fluid recovery circuit 19 and the third or fourth fluid recovery circuit 25 or 27 into the main fluid recovery circuit 36 for recovery thereby.

Fluid Recovery from Both the First and Second Actuators 5 and 6

In this case, the priority valve 34 assuming its second position B, a return fluid is permitted to flow only out of the first actuator 5 through the first fluid recovery circuit 15 into the main fluid recovery circuit 36 for recovery therein.

Since the first actuator 5 is the boom cylinder and has a holding pressure produced therein that is commensurate with the weights of the boom 8 and the arm 9 and that is greater than a holding pressure which the second actuator 6 has generated therein, it can be seen that it is thus possible to control each of the speeds of motion of the boom and arm cylinders while a return fluid is being recovered from the first actuator.

Figure 2:
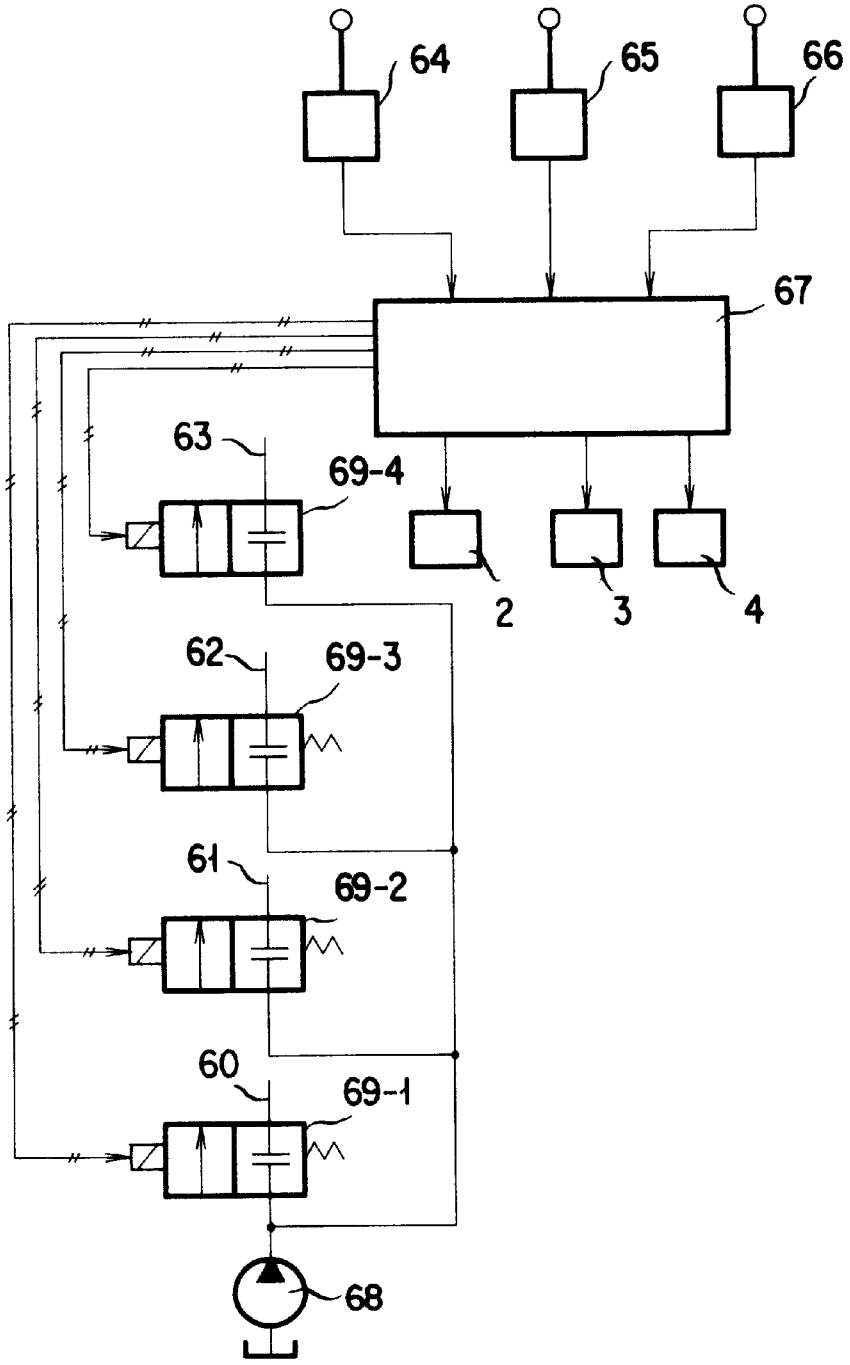
FIG. 2 is a circuit diagram that shows a control hydraulic circuit used in that first form of embodiment.

FIG. 2 shows a circuit diagram of a control circuit for the first, second, third and fourth pilot circuits 60, 61, 62 and 63. The controller 67 is shown to be furnished with operating signals from a first, a second and a third operating member 64, 65 and 66. A pilot pump 68 discharges a pressure fluid that is supplied to the first, second, third and fourth pilot circuit 60, 61, 62 and 63 via a first, a second, a third and a fourth electromagnetic valve 69-1, 69-2, 69-3 and 69-4.

The controller 67 furnished with an operating signal from the first operating member 64 provides a switching signal to be applied to the first directional control valve 2 and a signal indicating an electric current to be applied to the first electromagnetic valve 69-1. The controller 67 furnished with an operating signal from the second operating member 65 provides a switching signal to be applied to the second directional control valve 3 and a signal indicating an electric current to be applied to the second electromagnetic valve 69-2. The controller 67 furnished with an operating signal from the third operating member 66 provides a switching signal to be applied to the third directional control valve 4 and a signal indicating an electric current to be applied to the third or fourth electromagnetic valve 69-3 or 69-4.

Figure 3:
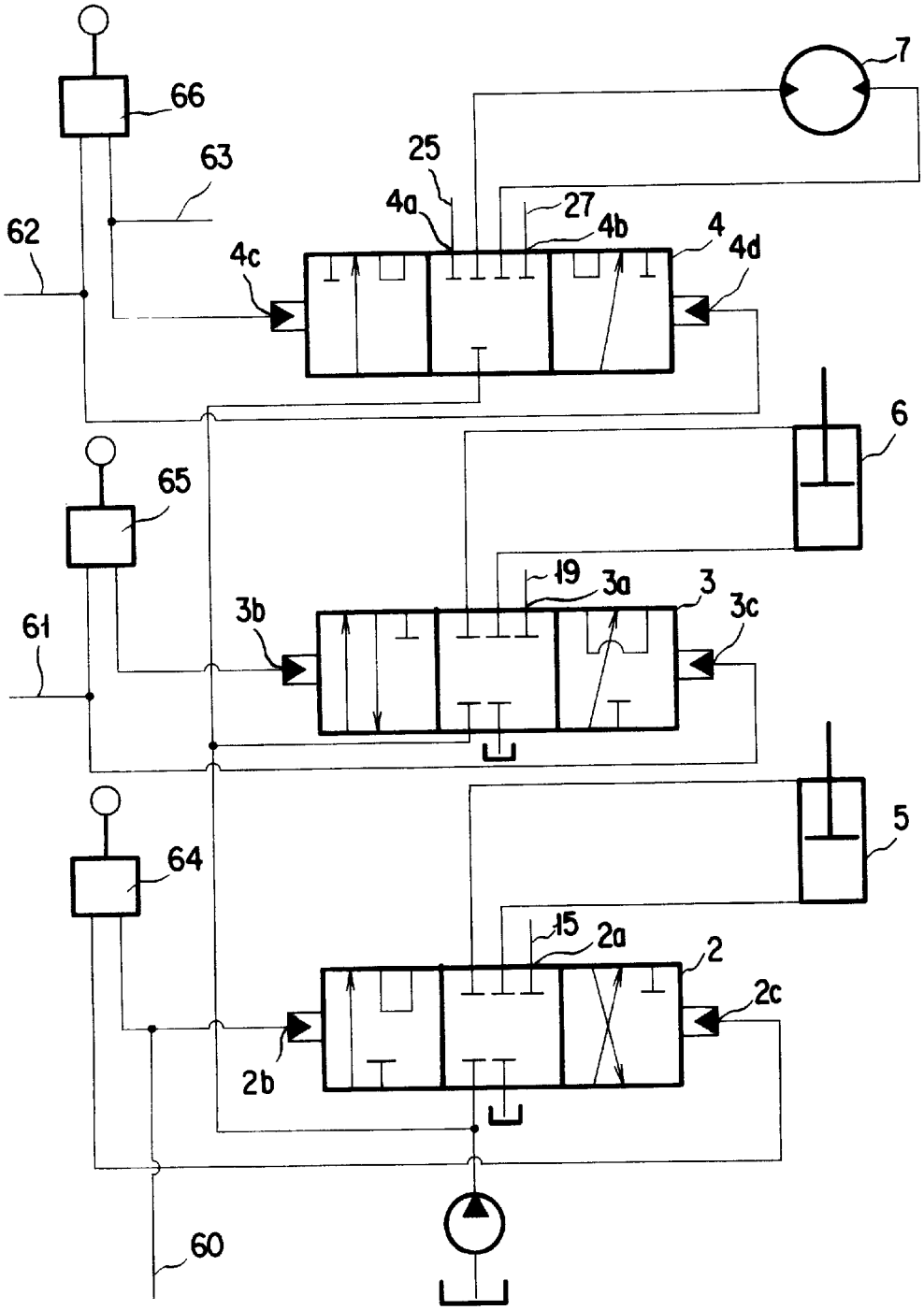
FIG. 3 is a circuit diagram that shows a control hydraulic circuit used in a second form of embodiment of the present invention.

FIG. 3 shows a circuit diagram of a control circuit that may be used with a second form of embodiment of the present invention. In this embodiment, the first, second and third directional control valves 2, 3 and 4 are each of a spool type, are each adapted to be switched with a pilot pressure signal and have return pressure fluid recovery ports 2*a,* 3*a,* 4*a* and 4*b,* respectively. Return pressure fluid flows from the actuators are passed through the first, second and third directional control valves 2, 3 and 4 into the first, second, third and fourth fluid recovery circuits, 15, 19, 25 and 27,respectively.

The first, second and third operating members 64, 65 and 66 are each a hydraulic pilot valve designed to supply a pilot pressure fluid to the respective pressure receiving portions 2*b,* 2*c;* 3*b,* 3*c;* 4*c,* 4*d* of each of the directional control valves, the pilot pressure fluid being also supplied to each of the first, second, third and fourth pilot circuits 60, 61, 62 and 63.

An explanation is next given of the specific structures of the priority valve 34, the selector valve 35, the back pressure compensating valve 37 and the fluid recovery check valve 40.

Figure 4:
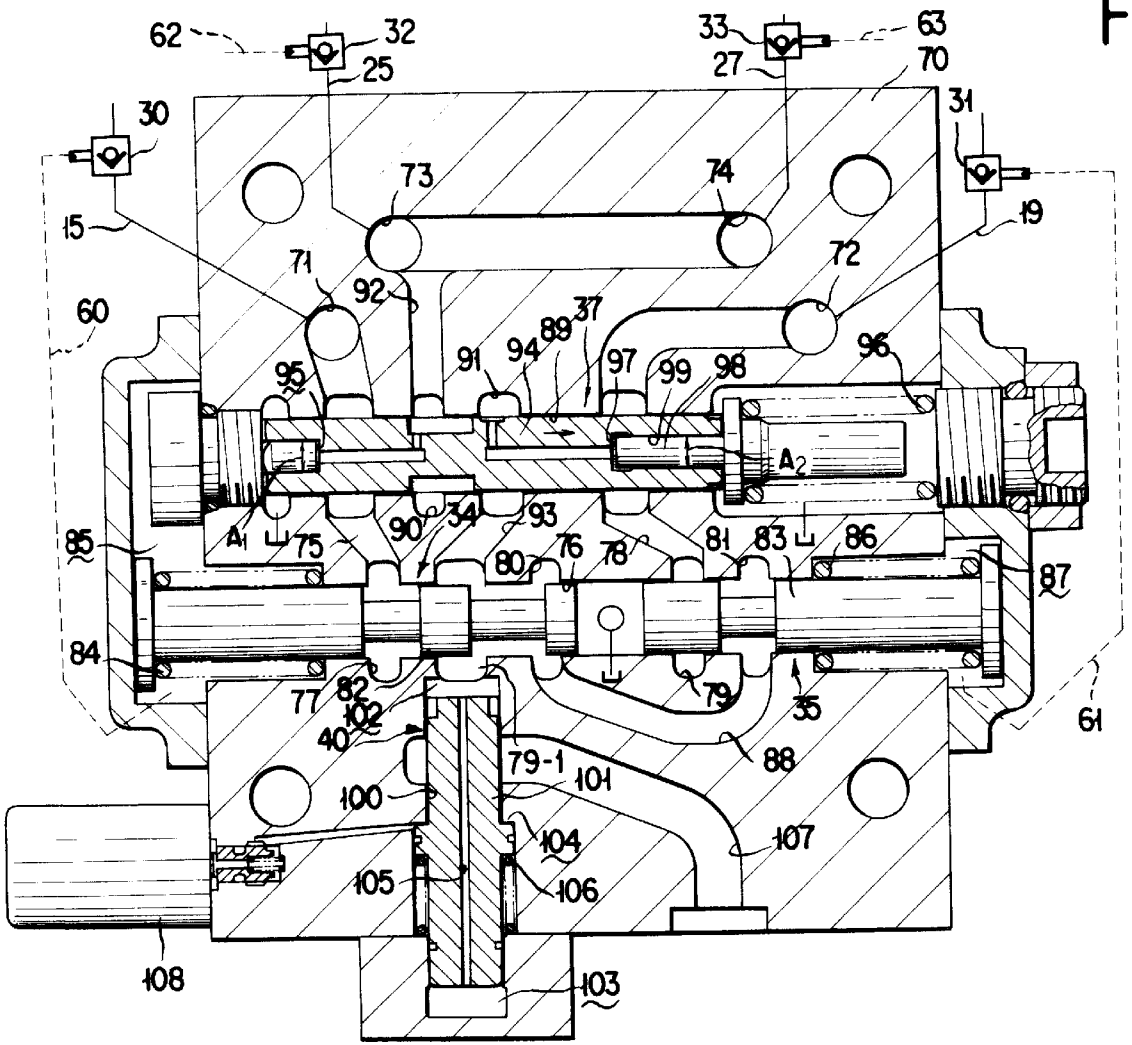
FIG. 4 is a cross sectional view that shows a combined specific structure including a priority valve, a selector valve and a back pressure compensating valve.

As shown in FIG. 4, a valve body 70 is formed with a first, a second, a third and a fourth fluid inlet port 71, 72, 73 and 74. The first, second, third and fourth fluid inlet ports 71, 72, 73 and 74 are connected to the first, second, third and fourth fluid recovery circuits 15, 19, 25 and 27.

The first fluid inlet port 71 is formed to communicate via a first fluid bore 75 with a first port 77 formed in the first spool bore 76. The second inlet port 72 is formed to communicate via a second fluid bore 78 with a second port 79 formed in the first spool bore 76. The first spool bore 76 is formed with a drain port 79-1, a third port 80 and a fourth port 81, and has a first and a second spool 82 and 83 inserted and fitted therein.

The first spool 82 is normally held by a spring 84 at a position that blocks a fluid communication between the first port 77 and the drain port 79-1 and establishes a fluid communication of the third port 80 with the drain port 79-1. And, when a pressure fluid is admitted into a first pressure receiving chamber 85, the first spool 82 is allowed to move against the spring 84 to a position that permits the first port 77 to communicate with the drain port 79-1 and blocks a communication between the third port 80 and the drain port 79-1.

Thus, the first spool 82, the first port 77, the third port 80 and the spring 84 together constitute the priority valve 34 previously shown and described. Then, the first port 77, the third port 80, the drain port 79-1 and the pressure receiving chamber 85 constitute the first fluid inlet port 34*a,* the second fluid inlet port 34*b,* the fluid outlet port 34*c* and the pressure receiving portion 34*d,* respectively.

The second spool 83 is normally held by a spring 86 at a position that blocks a fluid communication between the second port 79 and the fourth port 81. And, when a pressure fluid is admitted into the pressure receiving chamber 87, the second spool 83 is allowed to move to a position that permits the second port 79 to communicate with the fourth port 81. Further, the fourth port 81 is formed to communicate via a fluid path 88 with the third port 80. Thus, the second spool 83, the second port 79, the spring 86 and a pressure receiving chamber 97 together constitute the selector valve 35 previously shown and described.

The valve body 70 is formed with a second spool bore 89 that is in turn formed with an influent port 90 and a drain port 91. The influent port 90 is formed to communicate via a fluid bore 92 with the third and fourth inlet ports 73 and 74. The drain port 91 is formed to communicate via a fluid bore 93 with the drain port 79-1 mentioned above.

A third spool 94 is inserted into and fitted in the second spool bore 89. The third spool 94 is adapted to be thrusted under an inlet side pressure applied into the first pressure receiving chamber 95 to a position that allows the influent port 90 to communicate with the drain port 91. The third spool 94 is also arranged to be thrusted under an outlet side pressure acting into the second pressure receiving chamber 97 to a position that blocks the fluid communication between the influent port 90 and the drain port 91.

A piston 98, that is arranged to be thrusted by the spring 96, is fitted in an axial bore 99 in the third spool 89, forming the second pressure receiving chamber 97. There is thus provided the back pressure compensating valve 37 previously shown and described.

The valve body 70 is also formed with a stepped cylinder bore 100 to which a fluid recovery bore 107 is opened. A stepped piston 101 is inserted into and fitted in the cylinder bore 100, defining a first and a second chamber 102 and 103 and a cylinder chamber 104 in its opposite end sides and center region, respectively. The first chamber 102 is formed to communicate with the drain port 79-1 and the second chamber 103 is formed to communicate via an axial bore 105 with the first chamber 102. And, the cylinder chamber 104 is adapted to be supplied with a pressure fluid from an electromagnetic proportional pressure control valve 108 well known in the art.

The piston 101, thrusted upwards by the spring 106, acts to block a fluid communication between the first chamber 102 and the fluid recovery bore 107. Pressure fluid supplied into the cylinder chamber 104 causes the piston 101 to move downwards, permitting the first chamber 102 and the fluid recovery bore 107 to be in fluid communication with each other with an area of fluid communication that is proportional to the pressure of fluid supplied into the cylinder chamber 104. There is thus provided the fluid recovery check valve 40 previously shown and described.

While the fluid recovery check valve 40 is shown and apparent in FIG. 1 to have its opening as varied by a thrust force of a proportional solenoid, it should be noted that the fluid recovery check valve 40 may alternatively have its opening varied in proportion to a fluid pressure as shown in FIG. 4.

An explanation is next given of specific example of the operation of the system described.

Supplying a pilot pressure fluid into the first pilot circuit 60 to cause the first actuator 5 to operate to move the boom 8 downwards permits the first pressure receiving chamber 85 to be supplied with pressure fluid. Then, the first spool 82 moving rightwards to permit the first port 77 to communicate with the drain port 79-1, a return fluid from the first actuator 5 is allowed to flow via the fluid recovery check valve 40 into the fluid recovery bore 107.

Supplying a pilot pressure fluid into the second pilot circuit 61 to cause the second actuator 6 to operate to move the arm 98 downwards (excavating operation) permits the first pressure receiving chamber 87 to be supplied with pressure fluid. Then, the second spool 83 moving leftwards to permit the second port 79 to communicate with the fourth port 81, a return fluid from the second actuator 6 is allowed to flow through the second port 79, the fourth port 81, the fluid path 88, the third port 80 and the drain port 79-1 and then via the fluid recovery check valve 40 into the fluid recovery bore 107.

Supplying a pilot pressure fluid into the third pilot circuit 63 to operate the third actuator 7 causes the third spool 94 to move rightwards. Then, a return fluid from the third actuator 7 is allowed to flow through the influent port 90, the drain port 91, the fluid bore 93 and the drain port 79-1 and then via the fluid recovery check valve 40 into the fluid recovery bore 107.

Such operations are now described in detail. An influent side pressure Pa acts on the first chamber 95 and a drain side pressure Pb acts on the second chamber 97. Pressure balancing is then expressed as follows:

$$Pa \times A_1 = Pb \times A_2 = F_o - Pb \times A_2$$

where $A_1$ represents the pressure receiving area in the first chamber 95, $A_2$ represents the pressure receiving area in the second chamber 97, and $F_o$ represents the spring force by the spring 96.

Then, with $A_1=A_2$, $Pa \times A_1=F_o$. It is thus shown that the influent side pressure Pa is determined, independent of the drain side pressure Pb, by the spring force by the spring 96. When the influent side pressure Pa reaches a level that is commensurate with the spring force by the spring 96, the third spool 94 is moved rightwards to permit the influent port 90 to communicate with the drain port 91.

Where the first and third actuators 5 and 7 or the second and third actuators 6 and 7 are simultaneously operated, the return fluid flows out of the respective actuators are allowed to run together through the drain port 79-1 and then the merged flow to run via the fluid recovery check valve 40 into the fluid recovery bore 107.

In this case, if the return fluid from the first or second actuator 5 or 6 is greater in pressure, the pressure in the influent port 90 is allowed to rise to a reset level as described previously, thus permitting the pressure of return fluid from the third actuator 7 to rise to a given corresponding level, thereby maintaining a brake pressure against turning as required.

Where the first and the second actuators 5 and 6 are simultaneously operated, the first spool 82 acts to block a fluid communication between the third port 80 and the drain port 79-1, permitting the return fluid only from the first actuator 5 to be admitted through the fluid recovery bore 107.

Figure 5:
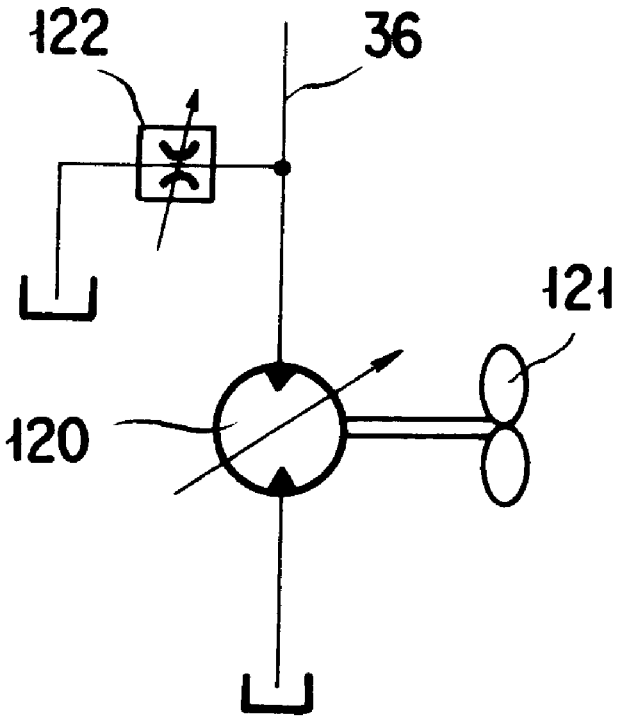
FIG. 5 is an explanatory view that shows other way to utilized a recovered pressure fluid.

As shown in FIG. 5, the main fluid recovery circuit 36 may be connected to the hydraulic motor 120 so that the hydraulic motor 120 may rotationally drive a load, e.g., a cooling fan 121. Further, there may be provided a variable flow rate control valve 122 at the influent side of the hydraulic motor 120.

This arrangement permits any recovered return fluid to rotationally drive the cooling fan 121 and changing the rate of flow of the fluid flowing through the variable flow rate control valve 122 to change the speed of rotation of the hydraulic motor 120 and thus to control the speed of rotation of the cooling fan 121.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the invention is not intended to be limited to the specific embodiments thereof set out above, but to include all possible embodiments thereof that can be made within the scope with respect to the features specifically set forth in the appended claims and encompasses all the equivalents thereof.

What is claimed is:

1. A hydraulic actuator return pressure fluid recovery system, comprising:

a plurality of fluid recovery circuits associated with a plurality of hydraulic actuators for accepting flows of a hydraulic pressure fluid returned from said actuators;

a main fluid recovery circuit; and a selector means for permitting at least one of said plural fluid recovery circuits selectively to communicate with said main fluid recovery circuit, wherein said selector means is adapted to selectively establish a first state in which any one of said fluid recovery circuits solely lies in fluid communication with said main fluid recovery circuit and a second state in which more than one of said fluid recovery circuits lie in fluid communication with said main fluid recovery circuit, and wherein, when a first fluid recovery circuit of said fluid recovery circuits is in fluid communication with said main fluid recovery circuit, said selector means prevents a second fluid recovery circuit of said fluid recovery circuits from being in communication with said main fluid recover circuit.

2. A hydraulic actuator return pressure fluid recovery system as set forth in claim 1, in which there is provided a back pressure compensating valve connected to only another of the fluid recovery circuits and adapted to permit a hydraulic return pressure fluid flow to pass therethrough selectively upon an influent side fluid pressure thereof exceeding a predetermined level.

3. A hydraulic actuator return pressure fluid recovery system as set forth in claim 1, in which each of said fluid recovery circuit includes an on/off valve, said on/off valve in said fluid recovery circuit in which a pressure occurs due to an external load in said actuator is opened.

4. A hydraulic actuator return pressure fluid recovery system as set forth in claim 2, in which each of said fluid recovery circuit includes an on/off valve, said on/off valve in said fluid recovery circuit in which a pressure occurs due to an external load in said actuator is opened.

5. A hydraulic actuator return pressure fluid recovery system as set forth in claim 1, in which each of said fluid recovery circuits includes: an on/off valve operable to be opened in response to a signal that operates a directional control valve to be switched over for supplying said actuator corresponding thereto with a hydraulic pressure fluid; and said selector means comprises:

a selector valve connected to said second fluid recovery circuit and operable to be opened in response to a signal that operates a directional control valve to be switched over for supplying said actuator corresponding thereto with a hydraulic pressure fluid; and a priority valve which prevents said second fluid recovery circuit from being in communication with said main fluid recovery circuit, when said first fluid recovery circuit is in fluid communication with said main fluid recovery circuit.

6. A hydraulic actuator return pressure fluid recovery system as set forth in claim 5, in which said selector means further comprises a back pressure compensating valve connected to only another of the fluid recovery circuits and adapted to permit a hydraulic return pressure fluid flow to pass therethrough selectively upon an influent side fluid pressure thereof exceeding a predetermined level.

* * * * *